US006038800A

United States Patent [19]

Seidel

[11] Patent Number: 6,038,800

[45] Date of Patent: Mar. 21, 2000

[54] ADVERTISING DISPLAY DEVICE

[76] Inventor: Gregg A. Seidel, 873 9th St., Manhattan Beach, Calif. 90266

[21] Appl. No.: 09/359,669

[22] Filed: Jul. 23, 1999

[51] Int. Cl.[7] ..... G09F 11/18

[52] U.S. Cl. ..... 40/517; 40/514; 40/515

[58] Field of Search ..... 40/517, 514, 515, 40/520, 518; 160/299, 305, 313

[56] References Cited

U.S. PATENT DOCUMENTS

| | | | |
|---|---|---|---|
| 92,137 | 6/1869 | Rankin . | |
| 183,480 | 10/1876 | Rice . | |
| 433,841 | 8/1890 | Williamson | 40/517 |
| 447,983 | 3/1891 | Strong | 40/517 |
| 570,515 | 11/1896 | Startzel . | |
| 971,319 | 9/1910 | Sheppard | 40/517 |
| 1,065,295 | 6/1913 | Connors . | |
| 1,364,223 | 1/1921 | Venard | 40/517 |
| 1,457,026 | 5/1923 | Hanses . | |
| 1,570,104 | 1/1926 | Vancil | 40/517 |
| 1,583,998 | 5/1926 | Richey | 40/517 |
| 1,590,862 | 6/1926 | Seaquist | 40/517 |
| 1,728,649 | 9/1929 | Winter | 40/517 |
| 1,919,830 | 7/1933 | Campbell . | |
| 2,589,609 | 3/1952 | Foster | 40/517 X |
| 2,589,641 | 3/1952 | Stewart . | |
| 2,651,127 | 9/1953 | Rubin et al. | 40/517 |
| 3,938,269 | 2/1976 | Catteau . | |
| 4,188,992 | 2/1980 | Segerljung . | |
| 4,292,751 | 10/1981 | Snyder, Jr. . | |
| 4,345,392 | 8/1982 | Cornell . | |
| 4,525,946 | 7/1985 | Olson . | |
| 4,679,822 | 7/1987 | Wolfe . | |
| 4,794,715 | 1/1989 | Cherwin . | |
| 4,825,571 | 5/1989 | Jennings . | |
| 5,097,611 | 3/1992 | Smollar et al. . | |

FOREIGN PATENT DOCUMENTS

| | | | |
|---|---|---|---|
| 316636 | 7/1929 | United Kingdom | 40/517 |

*Primary Examiner*—Terry Lee Melius
*Assistant Examiner*—William L. Miller
*Attorney, Agent, or Firm*—Jack C. Munro

[57] ABSTRACT

An advertising display device and method of manufacturing such which takes the form of a cylindrical housing which has an internal chamber. A sheet member is wound on a roller and is contained within the internal chamber. This sheet member is to be manually extendable from the housing with advertising indicia that is located on the sheet member to then being capable of being read by a human. The housing is to be attached to the front end of a product supporting shelf within a store. During manufacturing of the device, a mechanical tool is to be attachable to the roller for the purpose of winding the sheet member on the roller producing bias in a windup spring.

5 Claims, 3 Drawing Sheets

ADVERTISING DISPLAY DEVICE

BACKGROUND OF THE INVENTION

1) Field of the Invention

The field of this invention relates to display apparatuses and more particularly to an advertising and information display which is designed to be mounted on the front edge of a product supporting shelf within a store.

2) Description of the Prior Art

Typical self service retail stores, such as drugstores, supermarkets, computer software stores, liquor stores, and the like, have rows of multiple tier shelves which are to be used to support products for sale. The product, or the exterior package of the product, is visually displayed on the shelf. Generally, there are many units of a particular product stocked on that shelf. The consumer will normally select a product from the shelf without the assistance of a clerk. Therefore, the shelf also performs a dispensing function.

It is common for product manufacturers and distributors to want to include a display advertisement at their shelf location for a particular product. While a product is readily visible on a shelf, the mere presence of the product, because the product is displayed with numerous other products on the shelf, may be insufficient to stimulate consumer interest. Shelf space in a store is a valuable commodity. The amount of shelf space assigned to each product is at the minimum. A given product can become "lost" on a shelf amongst all the other products. Also, the product may be enclosed in a small package so that there is no large "advertising" surface to catch the consumer's eye or the available space on the package may be insufficient to contain all the information that a manufacturer or retailer wishes to impart to a potential purchaser. Additionally, the product may be packaged in a plain wrapping or, in the case of produce, no packaging at all. There also may be involved some kind of specialty promotion with a product that is not included on the package since the promotion may only run for a short period of time.

Manufacturers and retailers are becoming aware that shelf advertising can be an exceedingly effective way in which to sell goods. Not only can the advertising motivate a consumer's purchase, but it also can be informative to the consumer about the product. Shelf advertising is limited as to available space. The only convenient location for shelf advertising is at the front edge of the shelf which is short in length, usually no more than four to ten inches in length, and only occupies generally an inch to an inch and one-half in height. However, if some form of device could be mounted on the front edge of this shelf and the device constructed in a manner to be expandable to a larger area so that additional information can be printed on the larger area and then made available to the consumer only when the consumer is interested in obtaining that information, then such an advertising device would be most desirable. Also, when the consumer is not utilizing the device, the device assumes a retracted state occupying a minimal amount of space when it is not used.

In the past, it has been known to mount a scroll type of device on the front end of a shelf where the scroll can be unwound to display advertising or information about a product, and then when released by the consumer, the device retracts to a small sized, at-rest position. However, in the past, such scroll type of devices have been constructed to be complex and not capable of being manufactured at a relatively inexpensive cost which is inherently necessary in order for widespread usage of such devices. Another problem with former art scroll devices is that such visually block the price channel without including a space for the retailer to place price, inventory or bar code label. Modern stores rely on these labels for price, manage inventory and reorder stock. Additionally, such scroll type devices of the prior art have not been easily mountable on the front end of modern shelving requiring the use of an unattractive and rather large sized C-type of clamping device that is used to clamp onto the shelf. It would be far more desirable to have such an advertising device to be quickly and easily attached and detached to the front end of a shelf without utilizing of bulky in size and unattractive clamping devices specifically, attach the advertising device to the price channel of modern retail shelving.

In the past, another way to include advertising at the point-of-purchase location on a shelf is to mount a freestanding sign which extends outward from the shelf. However, such freestanding signs protrude into the aisle area which is used for the passage of the consumers with the result that such signs are frequently struck by the consumers and knocked free from the shelf therefore becoming ineffective. Also, the usage of such freestanding signs generally obscures the shelves making it somewhat difficult to the consumer to visually find a particular product that the consumer wishes to purchase. Also, such freestanding signs have to be quite small in size therefore being very limited as to the amount of information or advertising that could be placed thereon.

SUMMARY OF THE INVENTION

One of the objectives of the present invention is to construct an advertising display device which is to be mounted on the front edge (price channel) of a product support shelf located within a retail store making available a large amount of information about a product located on a shelf without obscuring of products that are located on the shelf.

Another objective of the present invention is to provide a compact, small in size, self-contained scroll-type of advertising display device which is relatively uncomplicated and can be easily and quickly attached to the front edge (price channel) of a product supporting shelf located within a retail store.

The advertising display device of the present invention utilizes a cylindrical housing which is basically hollow thereby forming an internal chamber. Mounted within the internal chamber is a roller with the roller being secured to an inner end of a sheet member. The outer end of the sheet member passes through a slot in the housing and extends exteriorly of the housing. One end of the housing is closed by an end cap which has a hole through which is to be conducted a drive pin which is to engage with a drive socket mounted in the roller. The drive pin is mounted by a clock spring within a drive pin mount with this drive pin mount to be attached to the end cap of the housing with the drive pin extending through the end cap engaging with the drive socket. Rotation of the drive pin mount will result in rotation of the roller and winding of the sheet material member on the roller and, when the sheet material member is completely wound on the roller, the drive pin can be pivoted a predetermined number of degrees which will cause further winding of a windup spring mounted within the internal chamber of the housing with this windup spring being mounted between the roller and the end cap. Releasing of the drive pin mount from the end cap will result in the end cap moving longitudinally relative to the housing to thereby be locked in place relative to the housing.

DETAILED DESCRIPTION OF THE PREFERRED EMBODIMENT

Figures 1, 2, 4:
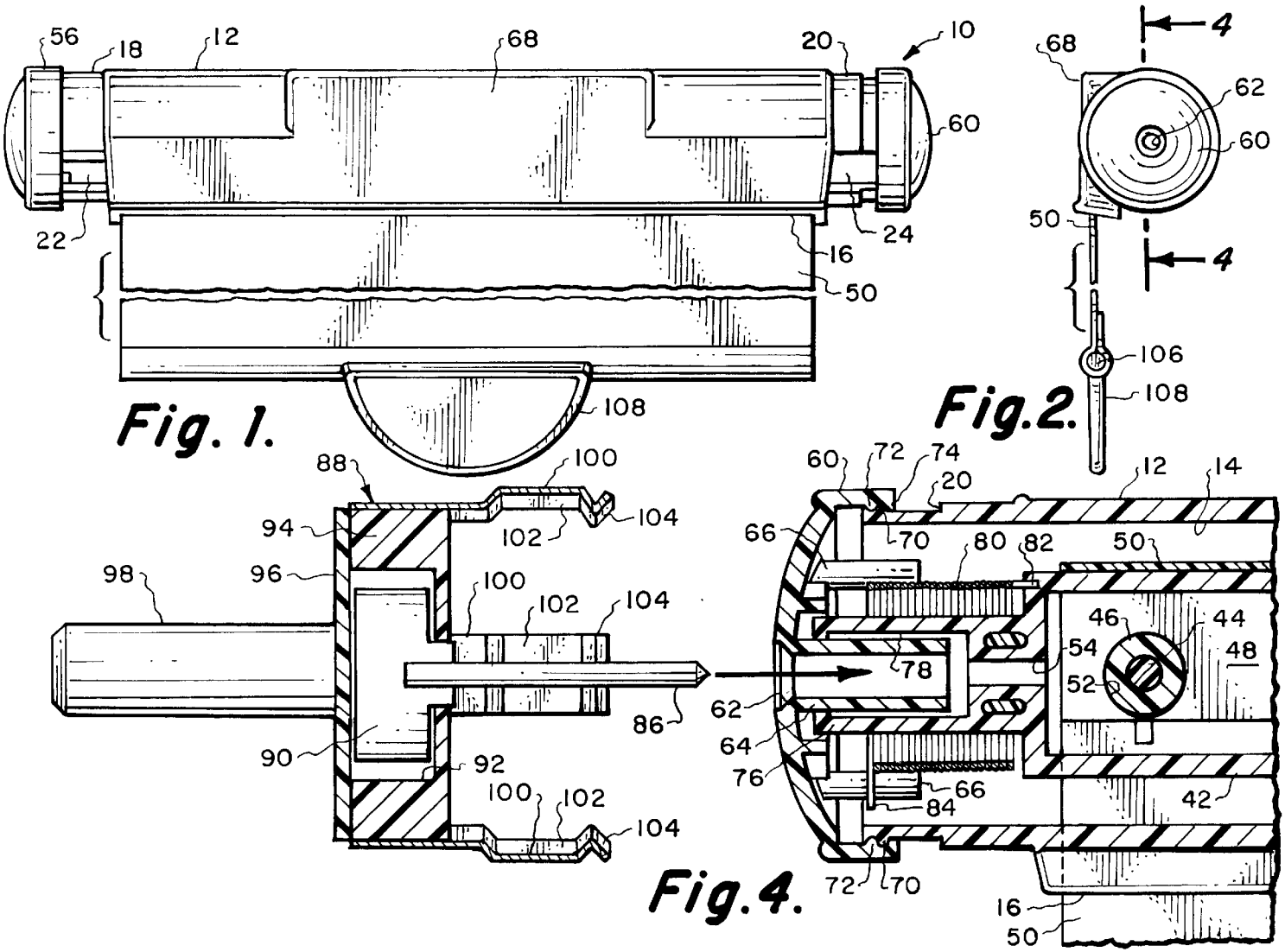
FIG. 1 is a front view of the advertising display device of the present invention showing the sheet member located in an extended position relative to the housing of the display device.
FIG. 2 is a right side view of the advertising display device of the present invention.
FIG. 4 is a transverse cross-sectional view through the housing of the advertising display device of the present invention taken along line 4—4 of FIG. 2 and also including the drive pin mount in cross-section in a position about to be inserted in conjunction with the housing of the advertising display device of the present invention.
Figure 3:
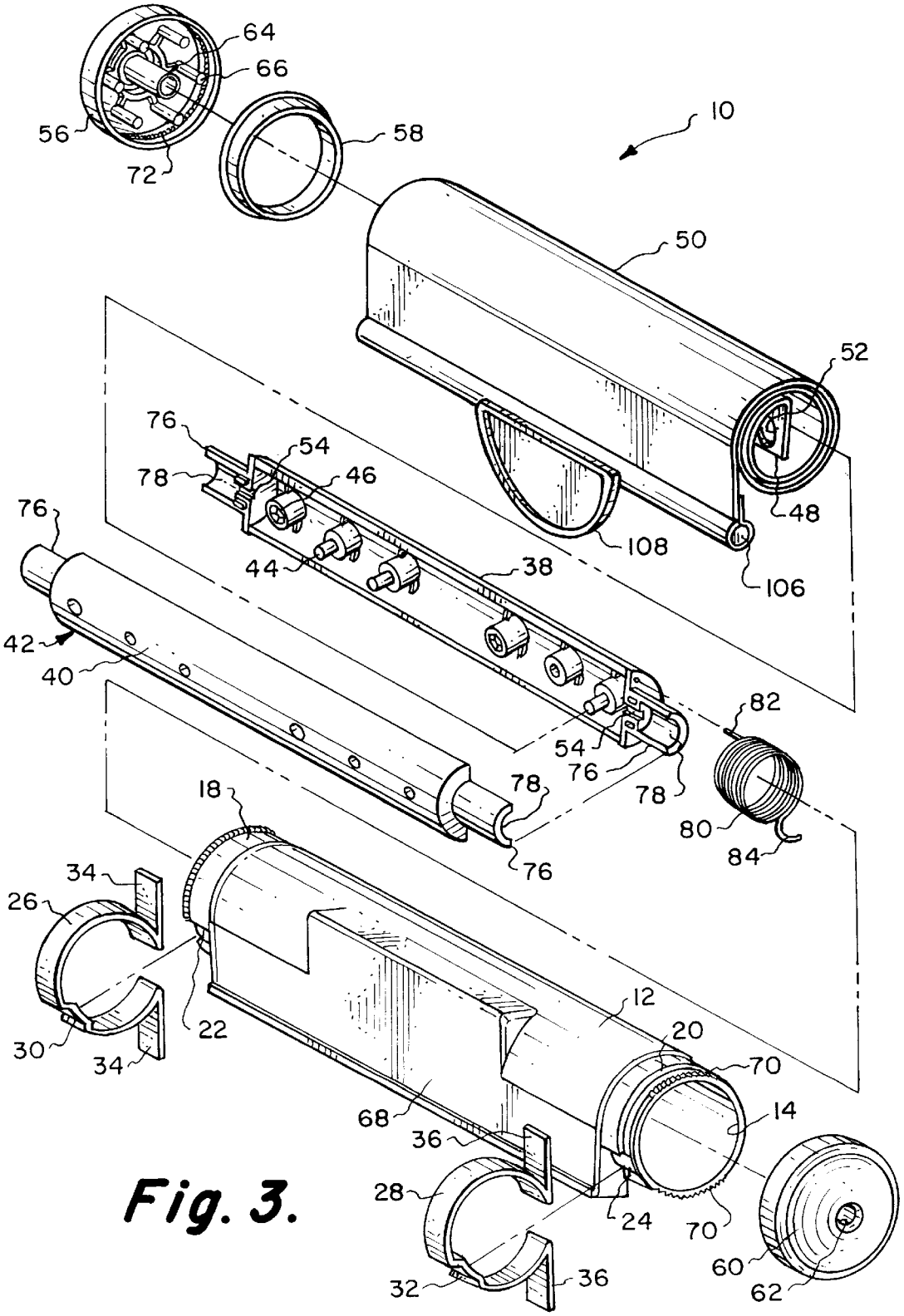
FIG. 3 is an isometric exploded view of the advertising display device of the present invention.

Referring particularly to the drawings, there is shown the advertising display device 10 of this invention. The advertising display device 10 has a cylindrical housing 12 which is, in essence, a hollow tube having open ends and having an internal chamber 14. The wall of the housing 12 includes a longitudinal slot 16. One end of the housing 12 includes a annular recess 18. The opposite end of the housing 12 includes a similar annular recess 20. Annular recess 18 includes an indentation 22. A similar indentation 24 is formed within the recess 20. An almost circular spring clip 26 is placed in engagement with the annular recess 18. A similar such spring clip 28 is to be placed in engagement with annular recess 20. The spring clip 26 includes an inward protuberance 30. The spring clip 28 includes a similar inward protuberance 32. Protuberance 30 is to mate with the indentation 22 which will then prevent the spring clip 26 from pivoting relative to the housing 12. In a similar manner, the indentation 32 is to matingly connect with the indentation 24 which will also prevent the spring clip 26 from pivoting relative to the housing 12.

The ends of the spring clip 26 are formed into opposing feet 34. A similar pair of opposing feet 36 are located at the ends of the spring clip 28. The opposing feet 34 and 36 are to be inserted within and biasing retained within the channel-shaped groove (which is not shown) of the front edge of a product supporting shelf within a retail store. Almost all such store shelving have a channel-shaped recess for the purpose of permitting engagement of price tags and other similar type of items. The spring clips 26 and 28 are designed to accommodate to this construction of shelves so as to provide an easy means of mounting the housing 12 onto the front edge of a shelf. However, if the shelving on which the housing is to be mounted does not include such a channel-shaped recess, then the spring clips 26 and 28 would not be utilized and another means of connecting, such as double sided adhesive tape, could be used to mount the housing 12 onto the edge of a shelf.

Contained within the internal chamber 14 is a roller 42 composed of roller halves 38 and 40. The roller halves 38 and 40 are constructed identically. Each roller half has an inside surface which is composed of a plurality of protruding pins 44 and a plurality of sockets 46. The roller halves 38 and 40 are to be reversed relative to each other and placed together with each pin 44 connecting with a socket 46. The inner end 48 of sheet member 50 is to be clamped between the roller halves 38 and 40, and when the roller halves 38 and 40 are tightly mounted together, the inner end 46 is tightly held in position. The inner end 48 is to include appropriate holes 52 each of which is to be located around one of the sockets 46.

When the roller halves 38 and 40 are connected together, there is formed a polygonal-shaped drive socket 54 located at each end of the roller 42. However, the drive socket 54 located at the outer end of the housing 12, which is covered by a cap 56, is of no purpose. The cap 56 is mounted in conjunction with the spacer ring 58 to firmly lock in position the cap 56 at the outer end of the housing 12. It is to be noted that the cap 56 is identical to the cap 60 mounted at the right side end of the housing 12. It is to be noted that the cap 60 includes a center hole 62 which connects to a sleeve 64. Surrounding the sleeve 64 and formed integrally with the cap 60 are a plurality (six in number) of evenly spaced apart pins 66. It is to be noted that the pins 66 and the center hole 62 have no function within the cap 56. These parts only have a function in conjunction with the cap 60. The function of the spacer sleeve 58 is to provide a positive lock arrangement for the cap 56 relative to the housing 12.

Figure 5:
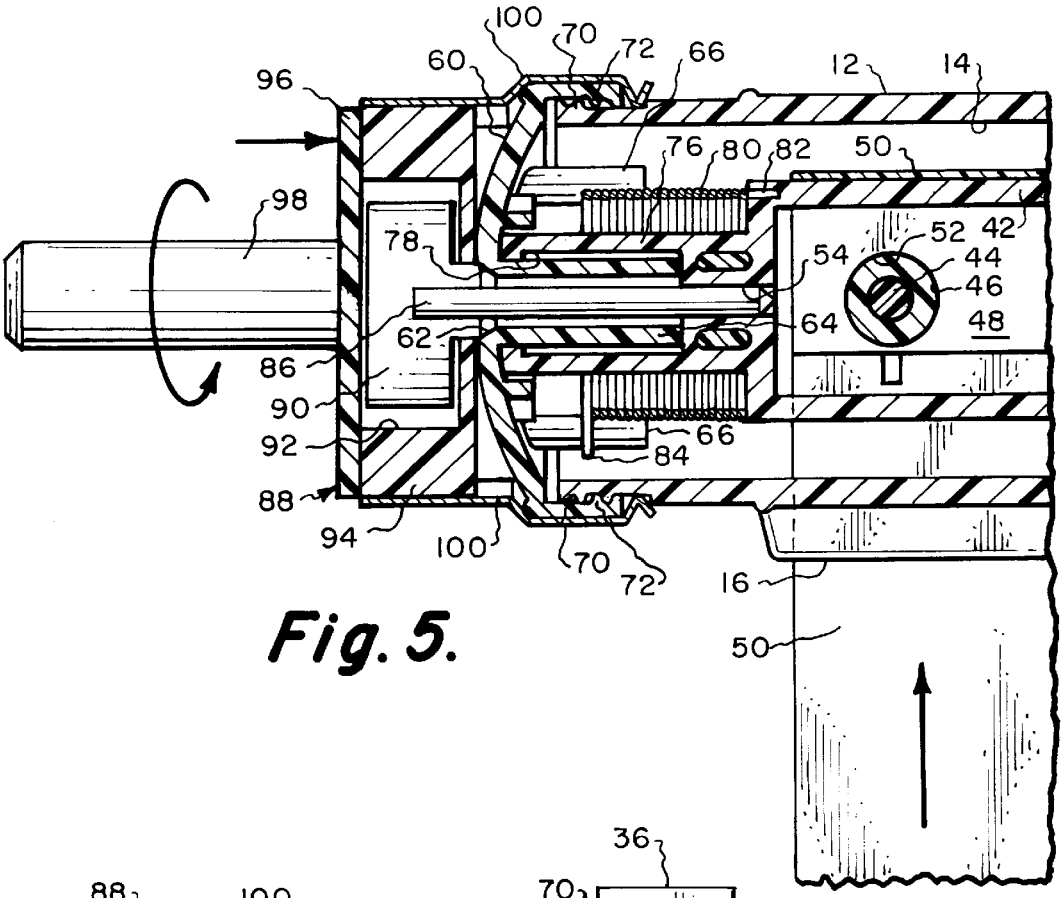
FIG. 5 is a cross-sectional view similar to FIG. 4 but with the drive pin mount in engagement with the housing of the advertising display device of the present invention.
Figure 6:
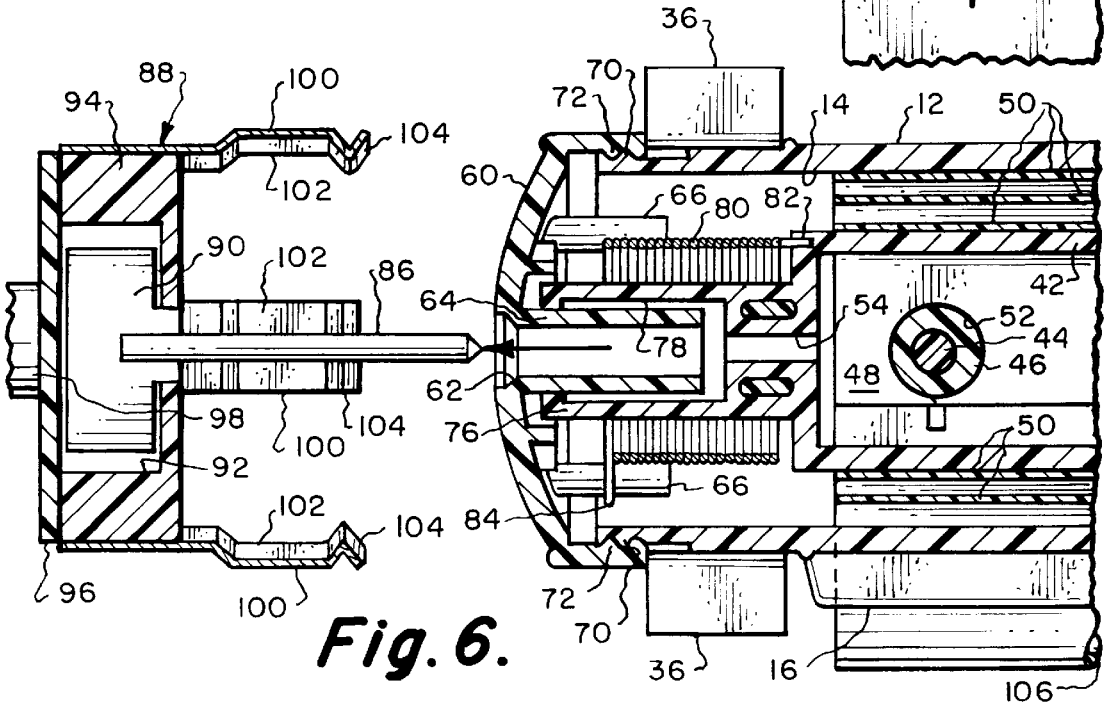
FIG. 6 is a cross-sectional view similar to FIG. 4 but with the drive pin mount in a position of being removed from the housing of the advertising display device of the present invention and showing one of the mounting clips being mounted in conjunction with the housing for permanently affixing of the housing onto the front edge of a product support shelf within a store.

The housing 12 includes a flattened area 68 which is designed to be utilized for the locating of advertising or indicia in the form of words or pictures such as price, bar code, inventory numbers, etc. The right end of the housing 12 includes a series of external teeth 70 which are actually divided into two short strips of teeth 70 located diametrically apart on the housing 12 directly adjacent the opening into the internal chamber 14 at the right end. The inside surface of the cap 60 includes an annular ring of internal teeth 72. The cap 60, with the spring clip 28 not engaged with the annular recess 20, is capable of a limited longitudinal movement of the inner annular flange 74 of the cap 60 to be capable of sliding the total width of the annular recess 20. With the cap 60 in an inward or unlocking position as shown in FIG. 5, the teeth 70 and 72 are disengaged. With the cap 60 in the outward or locked position, the teeth 70 and 72 are engaged. Engagement of teeth 70 and 72 will cause the cap 60 to be fixed to the housing 12. With the cap 60 in the unlocked position, the cap 60 is capable of being rotated relative to the housing 12.

At each end of the roller 42 there is formed a cylindrical guide 76. The cylindrical guide 76 is located at each end of the roller 42 and each guide 76 includes an internal bore 78. Sleeve 64 of the cap 56 is to be mounted within one of the bores 78 and the sleeve 64 of the cap 60 is to be mounted in the other of the bores 76. This will low frictionally and rotatably support the roller 42 relative to the housing 12. Surrounding sleeve 76 and located directly adjacent the cap 60 is a windup spring 80. The windup spring 80, which comprises a coil spring, has one end 82 mounted within a hole formed within the roller 42. The opposite end 84 is formed into a hook-shape and is designed to catch one of the pins 66 mounted on the inside of the cap 60.

When the end caps 56 and 60 are installed in position, it is necessary to initially wind the sheet material member 50 on the roller 42. In order to accomplish this, there is used a drive pin 86 which is mounted within a drive mount 88. The drive pin 86 is attached to one end of a clock spring 90. The clock spring 90 is mounted within a clock spring chamber 92 formed within a mount housing 94 of drive mount 88. The opposite end of the clock spring 90 is fixedly secured to the mount housing 94. The outer surface of the clock spring chamber 92 is closed by a disc 96 which is fixedly mounted onto the mount housing 94. The exterior surface of the disc 96 is fixedly secured to a shaft 98. The shaft 98 is normally to be connected to some type of a motorized rotational device which will normally include an internal clutch. Rotation of shaft 98 will rotate the drive mount 88.

Attached to the drive mount 88 and extending forwardly generally parallel to the drive pin 86 are a plurality of forwardly projecting fingers 100. Normally, there will be four to six in number of the fingers 100 located in an evenly spaced-apart manner fixedly mounted onto the mount housing 94. The inner edge of each of the fingers 100 include a recess 102. The outer edge of each of the recesses 102 terminate into a hook 104. The hook 104 is to be cammed over the exterior surface of the cap 60 which will result in the fingers 100 deflecting until the annular periphery of the cap 60 sets within the recesses 102. In this position, each hook 104 will have ridden over the annular periphery of the cap 60, slipping down into engagement with the inner end of the cap 60, as shown in FIG. 5. In this position, the drive pin 86, which is of a polygonal configuration, matingly engages with the drive socket 54. The drive pin 86 is passed through the center hole 62 to connect with the drive socket 54. Rotation of the shaft 98 in a clockwise direction will result in the roller 42 being rotated clockwise. This rotation is to continue until rod 106, which is wrapped by the outer end of the sheet member 50, abuts against the slot 16 of the housing 12.

Mounted to the sheet member 50 that is wrapped around the rod 106 is a pull handle 108. When the rod 106 abuts against the housing 12, the roller 42 stops and is not capable of being rotated. However, the mount housing 94 will continue to rotate and actually pivot some prescribed number of degrees such as two hundred seventy or three hundred sixty degrees. Because the fingers 100 are grasping onto the cap 60, the cap 60 not only rotates while the sheet member 60 is being wound on the roller 42 but also continues to rotate the additional prescribed number of degrees. This additional number of degrees is permitted by the clock spring 90 which, when it becomes completely tight, will then fix in position the mount housing 94 relative to the drive pin 86 and not permit relative motion therebetween. At that time, rotation of the shaft 98 is no longer possible, and, if there is a motor operated device driving the shaft 98, the clutch in conjunction with that motor operating device will proceed to slip. At this particular time, the drive mount 88 is then pulled free from the cap 60. This will move the cap 60 longitudinally engaging teeth 70 and 72 which thereby locks the cap 60 to the housing 12. The drive mount 88 is now free and separate from the device 10. The windup spring 80 is sufficiently biased to hold sheet member 50 in the wound up state on the roller 42 and because of the extra amount of turning of the cap 60 relative to the housing 12 after which rod 106 abuts the housing 12, there is an extra amount of bias within the windup spring 80 that will always keep the rod 106 abutting against the housing 12 when there is no external force applied to the pull handle 108 tending to withdraw the sheet member 50 from winding such from the roller 42.

With the device 10 installed in conjunction with the front end of a product supporting shelf in a store, the user is to merely grasp the pull handle 108 and pull such outwardly which will result in the sheet member 50 assuming an extended configuration from the housing 12 and unwinding from the roller 42. The windup spring 80 will be wound to a tighter configuration. When the sheet member 60 is fully extended and the user reads the advertising or information contained on, as being inscribed and printed or otherwise formed on the sheet member 50, the user then releases the pull handle 108 which will cause the sheet member 50 to be immediately rewound on the roller 42 with the rod 106 abutting against the housing 12. In essence, the sheet member 50 is moved from an extended position to a retracted position. Pull handle 108 has an exterior flattened surface which is designed to include some form of advertising indicia.

What is claimed is:

1. An advertising display device comprising:

a housing having an internal chamber;

a roller rotationally mounted to said housing, said roller being located within said internal chamber, said roller having a side end;

a drive socket mounted within said side end, said drive socket adapted to engage with a drive pin located exteriorly of said housing so said drive pin can be rotated to cause rotation of said roller within said housing;

a windup spring located within said internal chamber, said windup spring being mounted between said roller and said housing;

a sheet member having an inner end and an outer end, said inner end being secured to said roller, said sheet member to contain advertising indicia, a pull handle mounted on said outer end, whereby said sheet member is to be wound on said roller as said roller is rotated with rotation of said roller causing compressing of said windup spring which exerts a bias onto said roller tending to locate said sheet member in a tightly wound position with said pull handle located directly adjacent said housing, whereby said pull handle can be manually moved away from said housing causing extension of said sheet member exteriorly of said housing and upon release of said pull handle said bias of said windup spring will cause said sheet member to be rewound on said roller; and said housing including an end cap, said end cap having a center hole, said center hole being in alignment with said drive socket, said drive pin to be extendable through said hole to engage said drive socket.

2. The advertising display device as defined in claim 1 wherein:

said end cap being connected to one end of said windup spring, upon said pull handle being located directly adjacent said housing said roller then being fixed in position, said end cap being capable of being pivoted a preset number of degrees to produce a further bias within said windup spring.

3. The advertising display device as defined in claim 2 wherein:

said end cap being movable longitudinally on said housing between a locked position and an unlocked position, with said end cap in said unlocked position said end cap being rotatable relative to said housing, with said end cap in said locked position said end cap being fixed to said housing.

4. An advertising display device comprising:

a housing having an internal chamber;

a roller rotationally mounted to said housing, said roller being located-within said internal chamber, said roller having a side end;

a drive socket mounted within said side end, said drive socket adapted to engage with a drive pin located exteriorly of said housing so said drive pin can be rotated to cause rotation of said roller within said housing;

a windup spring located within said internal chamber, said windup spring being mounted between said roller and said housing;

a sheet member having an inner end and an outer end, said inner end being secured to said roller, said sheet member to contain advertising indicia, a pull handle mounted on said outer end, whereby said sheet member is to be wound on said roller as said roller is rotated with rotation of said roller causing compressing of said windup spring which exerts a bias onto said roller tending to locate said sheet member in a tightly wound position with said pull handle located directly adjacent said housing, whereby said pull handle can be manually moved away from said housing causing extension of said sheet member exteriorly of said housing and upon release of said pull handle said bias of said windup spring will cause said sheet member to be rewound on said roller; and said roller being formed of a pair of identical parts interlocked together with said inner end of said sheet member being clamped therebetween.

5. A method of manufacturing of an advertising display device comprising:

utilizing of a sheet member which has an inner end and an outer end upon which is located an advertisement;

attaching said inner end to a roller where said roller has a side end which includes a drive socket;

mounting said roller in a housing with the majority of said sheet member extending exteriorly of said housing by said sheet member passing through a slot formed within said housing;

mounting a spring between said roller and said housing;

inserting of a drive pin into interlocking engagement with said drive socket;

rotating said drive pin which causes said sheet member to be wound on said roller with only said outer end being located exteriorly of said housing and also producing a bias within said spring; and said inserting step includes temporarily fixing of a drive pin mount onto said housing with said drive pin being mounted by a clock spring relative to said drive pin mount wherein said clock spring provides for further rotating of said drive pin a predetermined number of degrees to produce an increased bias in said spring.

* * * * *